US006073688A

United States Patent [19]

Kato

[11] Patent Number: 6,073,688

[45] **Date of Patent: *Jun. 13, 2000**

[54] FLAT TUBES FOR HEAT EXCHANGER

[75] Inventor: Soichi Kato, Saitama, Japan

[73] Assignee: Zexel Corporation, Tokyo, Japan

[ * ] Notice: This patent is subject to a terminal disclaimer.

[21] Appl. No.: 08/887,643

[22] Filed: Jul. 3, 1997

[30] Foreign Application Priority Data

Jul. 3, 1996 [JP] Japan ..... 8-173306
Jul. 3, 1996 [JP] Japan ..... 8-173476

[51] Int. Cl.[7] ..... F28F 1/06

[52] U.S. Cl. ..... 165/177; 165/173; 165/183

[58] Field of Search ..... 165/170, 177, 165/183, 173

[56] References Cited

U.S. PATENT DOCUMENTS 3,708,012 1/1973 Zimprich ..... 29/890.053 X
5,052,479 10/1991 Nakajima et al. ..... 165/173 X
5,172,476 12/1992 Joshi ..... 29/890.053
5,186,250 2/1993 Ouchi et al. ..... 165/177
5,441,105 8/1995 Brummett et al. ..... 165/170 X
5,689,881 11/1997 Kato ..... 165/177 X

*Primary Examiner*—Leonard Leo
*Attorney, Agent, or Firm*—Kanesaka & Takeuchi

[57] ABSTRACT

A flat tube 2 for a heat exchanger which is formed by bending a single plate or overlaying two plates, wherein long beads 11 in a plurality of rows are previously formed on the plate in the longitudinal direction of the plate, the plate has its surface, to which the respective long beads are opposed, formed flat, the tops of the respective long beads 11 and the flat surface are joined, a plurality of passages 12 for a medium are formed within the tube by long beads and the flat surface, sections at the tube ends to be inserted into the header tanks 3, 4 are pressed back to be flat to form tube insertion sections, and a wall relief, which is formed to protrude in the breadth direction of the tube when the tube insertion sections are formed, is used as a stopper 16 to restrict a tube insertion level.

3 Claims, 9 Drawing Sheets

(1)

(2)

(1)

(2)

(3)

(1)

(2)

FLAT TUBES FOR HEAT EXCHANGER

BACKGROUND OF THE INVENTION

1. Field of the Invention

The invention relates to a flat tube for a heat exchanger which has long beads formed to form a plurality of passages within the tube, and particularly enables to securely determine a tube insertion level.

The invention relates to a flat tube for a heat exchanger which has long beads formed to form a plurality of passages within the tube and pressure resistance enhanced, and particularly the improvement of compressive strength in the neighborhood of joined sections between the flat tubes and the header tanks.

2. Description of the Related Art

Generally, a conventionally known laminated heat exchanger has a plurality of flat tubes laminated in parallel to one another, both ends of the respective flat tubes connected to two header pipes, and inlet and outlet joints disposed at predetermined points of the header pipes to receive and feed a heat-exchanging medium. And, in this heat exchanger, the fed heat-exchanging medium is meandered a plurality of times to flow between the header pipes through the flat tubes while heat-exchanging with outside. The flat tube used in such a laminated heat exchanger, as shown in FIG. 11 in a transverse cross sectional view, is formed by brazing two plates 21, 21 which are formed of brazing sheets formed to have a predetermined size into a flat tube 20. And, a plurality of beads 22, 22 which are protruded to a height so as to contact the end surfaces with the inner surface of the other plate are formed at predetermined points of these plates 21, 21 along its longitudinal direction to form a plurality of passages 24, 24 for the medium within the tube, thereby enhancing a heat-exchanging efficiency and improving pressure resistance of the tube itself. And, both ends of the tube are formed to have flat sections without any beads so as to be inserted into the insertion holes of the header pipes, so that airtightness between the tubes and the header pipes is secured.

Reference numerals 23, 23 denote flat joined sections disposed at both ends of the plates 21, 21, and joined areas are expanded by these joined sections 23, 23, so that satisfactory brazing strength can be secured. And, in addition to this two-split structure, a flat tube is known to be formed by bending a single plate and mutually bonding the ends in the breadth direction of the plate.

Besides, the heat exchanger provided with such flat tubes is precision equipment and needed to have pressure resistance to meet respective applications. For example, the heat exchanger to be used as a condenser is required to have high pressure resistance, and adhesion of respective parts by brazing is required to be satisfactory.

Furthermore, in assembling this flat tube to the header pipes, it is significant to control the insertion level of the flat tube into the header pipes. Specifically, if the respective tube insertion levels can not be kept constant, the flow rate of the medium flowing through the respective tubes may be deviated, or the smooth flow of the medium between the tubes and the header pipes may be adversely affected, thus it is directly related to the heat-exchanging performance, and the pressure resistance of tubes may be deteriorated.

For example, in a tube group consisting of a plurality of tubes, since the medium flows relatively smoothly at the tube ends which are inserted in a small extent into the header pipes, it flows in a large amount into them, but at the tube ends which are inserted in a large extent into the header pipes, such flow-in is prevented and the medium flows in a small amount. The tubes into which the medium flows in a large amount are insufficient to effect heat exchange, and the tube group as the whole has its heat-exchanging performance degraded.

And, when the tube insertion level is not uniform as described above, the flat sections of the tubes formed in the neighborhood where the tubes are joined with the header pipes have a different length, and as compared with the short flat sections, the long flat sections are easily deformed by the internal pressure due to the medium, and the tubes as the whole are degraded in pressure resistance.

And, as a method to secure the precision of the tube insertion level, various types of stopper members are generally disposed at a predetermined point in the tubes, namely a distance according to the tube insertion level from the tube ends.

It is known to dispose stoppers by, for example, (1) projections which are formed at predetermined points on the flat sections disposed at the tube ends to intersect at right angles in the longitudinal direction of the tube and to protrude in vertical directions by pressing and used as stoppers (e.g., Japanese Patent Laid-Open Publication No. Hei 2-242095), (2) insertion sections which suit the header pipe insertion holes are formed at both ends of the flat tubes, and contact sections which serve as stoppers are formed in the longitudinal direction of the tubes (e.g., Japanese Utility Model Laid-Open Publication No. Hei 2-28986), (3) predetermined sections of tubes in the breadth direction are pressed to be flat to form projections which are protruded outside in the breadth direction of the tubes, and the projections are used as stoppers (e.g., Japanese Utility Model Laid-Open Publications No. Hei 3-21664, No. Hei 7-2780, No. Hei 7-2781), and stopper members which are formed on the side of the header pipe instead of forming on the side of the tubes are also known. Specifically, there is also proposed (4) header pipes have a two-split structure with a tube divided at the center line in the longitudinal direction, and stopper projections which are in contact with the tube ends are integrally formed at predetermined points in the header pipes in which the tubes are inserted (e.g., Japanese Patent Laid-Open Publication No. Hei 6-94384).

And, a laminated heat exchanger provided with such flat tubes is produced by assembling respective parts into a predetermined structure and integrally brazing in a furnace. Specifically, fins are disposed between the respective flat tubes, both ends of the flat tubes are inserted into the tube insertion holes of the header pipes and fixed by a jig, and integrally brazed in the furnace. Therefore, the joined surfaces of the tube insertion holes of the header pipe and the flat tubes and the end faces of the beads in the flat tubes are joined by integrally brazing.

However, the conventional flat tubes for a heat exchanger described above had the following disadvantages.

Specifically, (1) described above needs a separate process for the projections for press forming of the flat sections on the tubes, and since the projections are formed to intersect at right angles in the longitudinal direction of the tube, the passage shape in the tube is disturbed, and the smooth flow of the medium is disturbed in the neighborhood of the inlet and outlet sides of the tubes. Especially, the liquefied medium might be accumulated at the projections on the lower side, degrading the heat-exchanging performance.

And, (2) described above has complex structures at the insertion and contact sections of the tube ends, being disadvantageous because not suitable for producing in a large quantity. And, when the contact sections are formed in the longitudinal direction of the tubes, the contact sections are not easily used for heat-exchanging, degrading the efficiency of the heat exchanger.

Besides, (3) described above forms a part of the tube by pressing and needs to process without deforming the tube itself, requiring high processing precision. Especially, when the tubes to be used for a compact and light-weight type are thin, high processing precision is required to prevent the processed parts from being communicated with the inner passage, or pressure resistance of the processed parts may be degraded.

Furthermore, (4) described above disposes the stopper projections integrally at the predetermined points inside the header pipes, and the header pipes are required to have the two-split structure. Therefore, the structure cannot be made simple, it is disadvantageous to produce in a large quantity, and the production cost cannot be lowered. And, the stopper projections are positioned in the neighborhood of the tube ends where the medium is flown in or out, and the flow of medium within the header pipes and through the tubes may be disturbed by the stopper projections.

Besides, there are proposed such a flat tube in which beads are formed in spots to cause turbulence in the medium flowing the interior, thereby promoting heat exchange by a turbulence effect (e.g., Japanese Patent Laid-Open Publication No. Hei 7-19774), beads are not formed in the neighborhood of the joined sections of the flat tubes and the header tanks to make them flat, thereby securing the joint between the flat tubes and the header tanks (e.g., Japanese Patent Laid-Open Publication No. Hei 6-159986), and joining sections of the header tanks are extended towards the tubes to cover the outsides of the tube ends, thereby securing the joint (e.g., Japanese Patent Laid-Open Publication No. Hei 8-49995).

And, a laminated heat exchanger provided with such flat tubes is produced by assembling respective parts into a predetermined structure and integrally brazing in a furnace. Specifically, fins are disposed between the respective flat tubes, both ends of the flat tubes are inserted into the tube insertion holes of the header tank and fixed by a jig, and integrally brazed in the furnace. Therefore, the joined surfaces of the tube insertion holes of the header tank and the flat tubes and the end faces of the beads in the flat tubes are joined by integrally brazing.

However, the conventional flat tubes for a heat exchanger described above provided with the long beads in a plurality of rows had a disadvantage that pressure resistance is lowered in the neighborhood of the joined sections with the header tanks.

Specifically, as shown in FIG. 12 for example, when distances x, y from end sections 22*a* of respective long beads of flat, tubes forming flat sections which are disposed instead of beads at both ends of a flat tube 20 to the outer periphery of a header tank 4 to which the flat tube 20 is connected are different to each other, a longer one is disadvantageous in view of pressure resistance, the tube 20 is largely deformed, and the heat-exchanging performance may be failure and the structure may be damaged. And, when the tube 20 is deformed by the pressure of the medium flowing therein and all tubes 20, 20 for the beat exchanger are also deformed, the shape of the heat exchanger as the whole is deformed due to a totaled deformation force, and airtightness of the joined sections between the tubes 20 and the header tanks 4 may not be retained. Therefore, since the flat tubes cannot keep sufficient pressure resistance, a core is deformed and performance is degraded. For example, a condenser has specifications disadvantageous in view of satisfying pressure resistance.

The flat sections of the tube 20 are desired to be close to the tube insertion hole of the header tank 4 and small as much as possible, but it is hard to make it uniform due to deviations in assembling the heat exchangers. And, a step for especially uniformizing may be disposed, but it increases the production cost because the number of process steps is increased.

Therefore, as shown in FIG. 13 the bead end sections 22*a* are formed into a shape to intersect at right angles in the longitudinal direction of the tube, the header tank 4 is formed of two members 4A, 4B, the header tank 4B opposed to the tubes 22 is formed to have a transverse cross section in the same shape to intersect at right angles, and the flat section of the tube 20 may be removed. But, the header tank 4 has its shape limited and its design is also limited, and productivity of the tank and performance of the heat exchanger may be interfered. Besides, when the header tank 4B is formed to have a transverse cross section in the above-described shape of intersecting at right angles, pressure resistance is insufficient.

SUMMARY OF THE INVENTION

In view of above, the present invention aims to provide a flat tube for a heat exchanger with pressure resistance enhanced and reliability improved with respect to a tube having beads formed previously along the overall length in its longitudinal direction.

The invention relates to a flat tube for a heat exchanger which is formed by bending a single plate or overlaying two plates, wherein long beads in a plurality of rows are previously formed on the plate in the longitudinal direction of the plate, the plate has its surface, to which the respective long beads are opposed, formed flat, the tops of the respective long beads and the flat surface are joined, a plurality of passages for a medium are formed within the tube by the long beads and the flat surface, sections at the tube ends to be inserted into the header tanks are pressed back to be flat to form tube insertion sections, and a wall relief, which is formed to protrude in the breadth direction of the tube when the tube insertion sections are formed, is used as a stopper to restrict a tube insertion level.

As described above, by using the flat sections at the tube ends for insertion, namely forming the beads, which have been once formed, into the flat sections, again the wall reliefs protruded in the breadth direction of the tube can be used as the stoppers, the insertion level accuracy of the flat tube into the header tubes can always be secured stably, performance and pressure resistance can be enhanced, and a flat tube for a heat exchanger with improved reliability and quality can be obtained.

The invention relates to a flat tube for a heat exchanger which is formed by bending a single plate or overlaying two plates, wherein long beads in a plurality of rows are formed on the plate in the longitudinal direction of the plate, the plate has its surface, to which the respective long beads are opposed, formed flat, the tops of the respective long beads and the flat surface are joined, a plurality of passages are formed by the long beads and the flat surface, and a distance between the end sections of the respective long beads and the outer periphery of the header tanks is determined to be constant.

Thus, by determining the bead end sections of the flat tubes to correspond to the outer shape of the header tank, the flat tube for the heat exchanger which can have the enhanced pressure resistance and improved reliability can be obtained. Specifically, since the end sections are disposed on the respective beads and a distance from the end sections to the outer periphery of the header tank is determined to be constant, the pertinent sections of the tubes not provided with the beads are prevented from having an uneven stress, and pressure resistance can be improved.

DESCRIPTION OF THE PREFERRED EMBODIMENT

Figure 1:
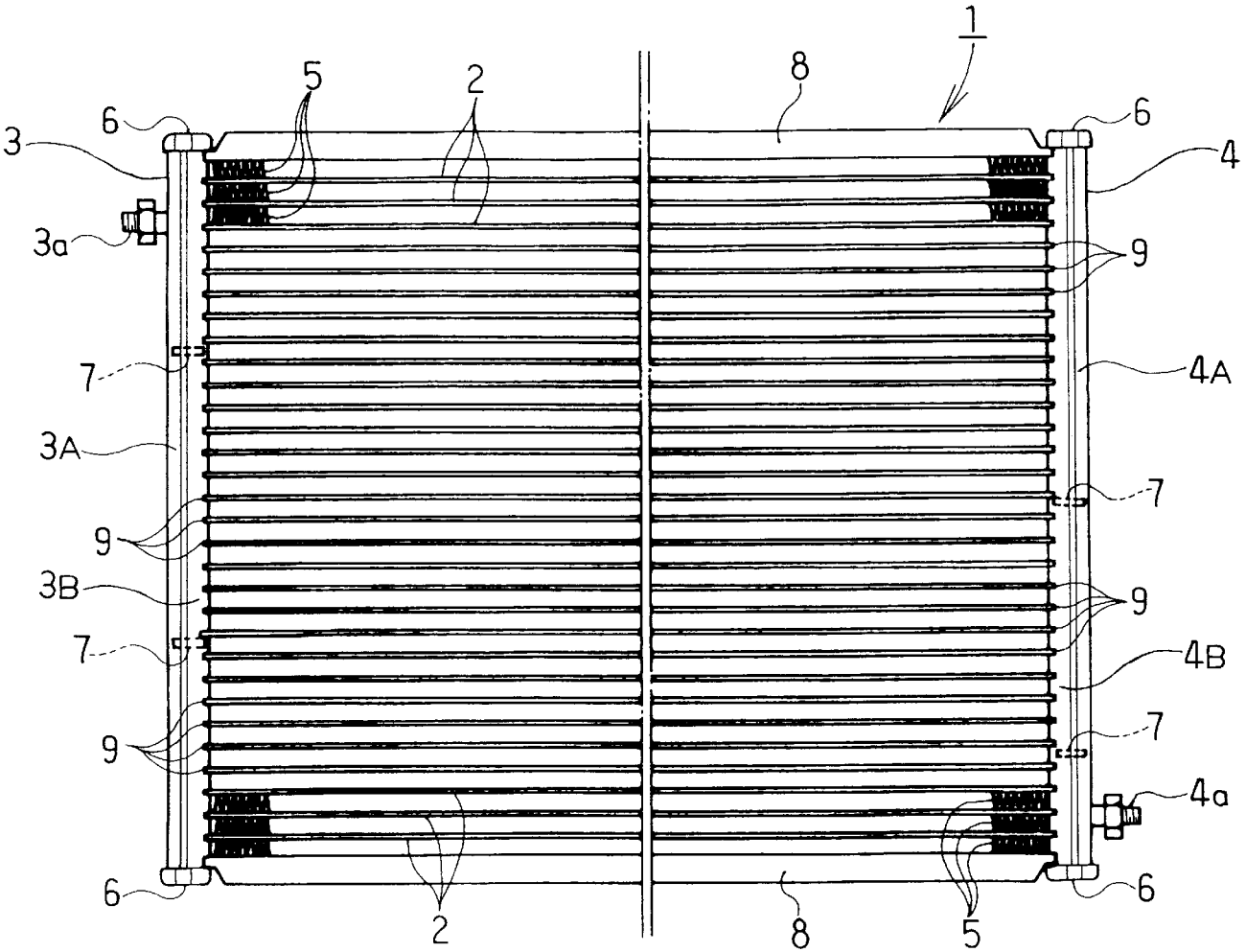
FIG. 1 is a front view of a laminated heat exchanger according to a first embodiment of the invention.

As shown in FIG. 1, a laminated heat exchanger 1 having flat tubes 2 in this embodiment has the flat tubes 2 in multiple numbers having the same length laminated in parallel to one another through thin plate corrugated fins 5 and both ends of these flat tubes 2 communicated to two erected header pipes 3, 4. And, the upper and lower openings of the respective header pipes 3, 4 are sealed by a blind cap 6, their predetermined positions are communicated with an inlet joint 3*a* to receive a heat-exchanging medium from outside and an outlet joint 4*a* to discharge outside, and the interiors of the header pipes 3, 4 are divided as predetermined by partition plates 7. In FIG. 1, reference numeral 8 denotes a side plate which is disposed at the top and bottom of the laminated flat tubes 2 to protect the corrugated fins 5 and also to reinforce the structural strength of the heat exchanger 1.

And, the heat-exchanging medium received from the inlet joint 3*a* is meandered a plurality of times to flow between the right and left header pipes 3, 4 while heat-exchanging, and discharged from the outlet joint 4*a*. Specifically, the medium flown into the heat exchanger 1 is meandered downwards within the heat exchanger 1 in a unit of a group of a predetermined number of flat tubes 2.

The above-described basic structure is common in respective embodiments to be described afterwards, and the same description will be omitted for simplification.

Figure 2:
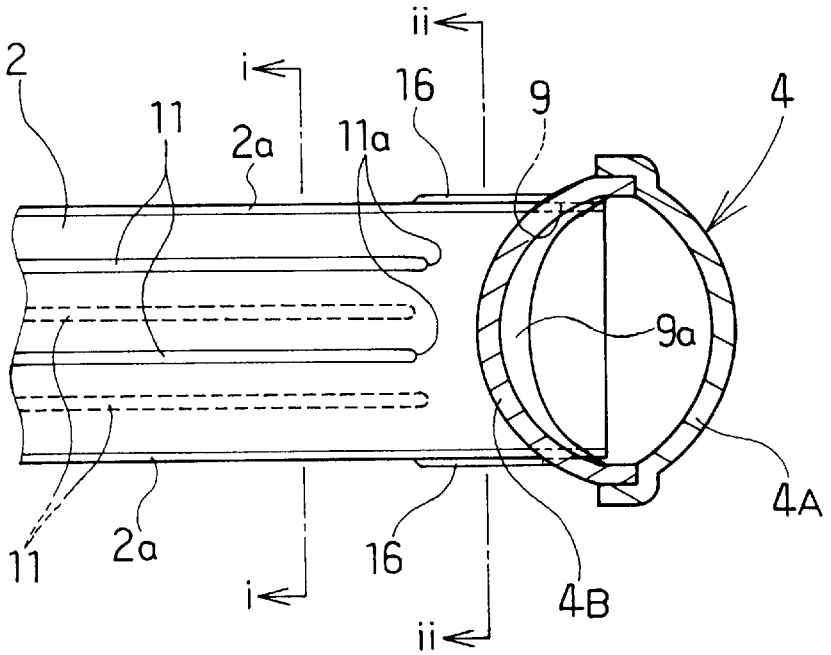
FIG. 2 is a partly enlarged plan view showing a joined section of a flat tube and a header pipe with parts partially broken away according to the first embodiment.
Figure 3:
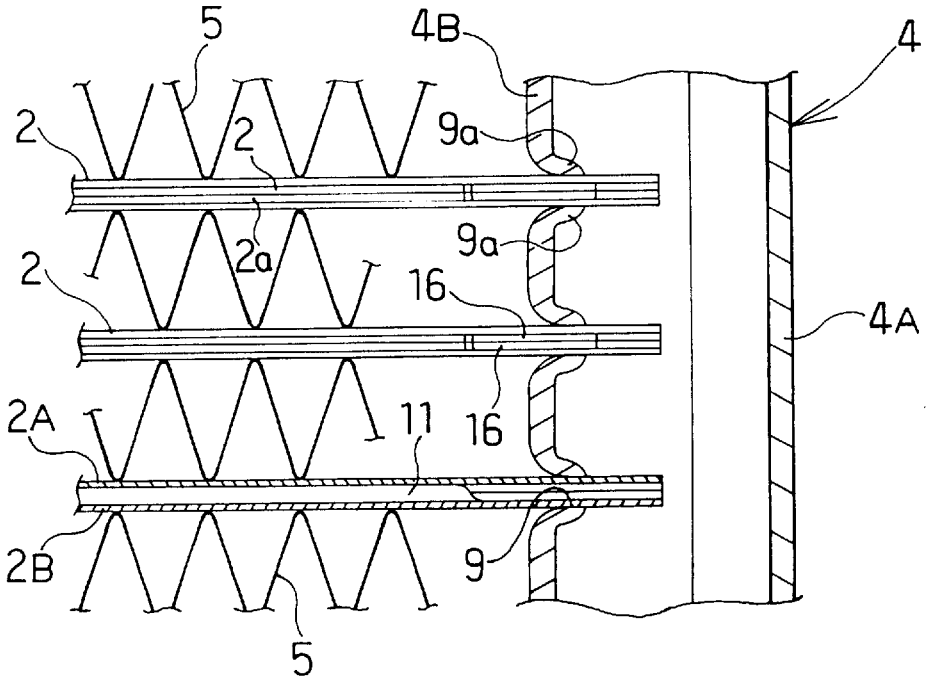
FIG. 3 is a vertical sectional view showing joined sections of flat tubes and a header pipe according to the first embodiment.

As shown in FIG. 2 and FIG. 3, the header pipes 3, 4 are formed of aluminum material having a predetermined thickness into a two-split structure. Specifically, the respective header pipes 3, 4 are disposed by combining and erecting two header tank members 3A, 3B and 4A, 4B which have their transverse cross section in a semitubular shape. And, these header tank members 3A, 3B and 4A, 4B have inner and outer diameters with a different round radius and provided with flat joining portions in the same way as the tube 2 to be described afterwards.

And, as shown in FIG. 1, the upper and lower openings of the header pipes 3, 4 are sealed by the blind cap 6 which has the shape of a cap to cover the openings, the upper part of the header pipe 3 is provided with the inlet joint 3*a*, and the lower part of the header pipe 4 is provided with the outlet joint 4*a*. And, the heat exchanger 1 is connected from the inlet and outlet joints 3*a*, 4*a* to an outside instrument through a pipe, and the heat-exchanging medium is flown to circulate between them. [0025]

Besides, the partition plates 7 are disposed at predetermined positions in the respective header pipes 3, 4 to divide the interior of the header pipes 3, 4 into predetermined sections. Specifically, these sections are formed to sequentially decrease the number of the flat tubes 2 communicated with the respective sections towards the bottom side. Therefore, the medium in the initial state with a large difference of temperature from the outside is passed through the large number of flat tubes 2 to have its difference of temperature decreased by heat-exchanging and passed through a relatively small number of flat tubes 2, so that heat-exchanging can be made efficiently, and the volume of the heat exchanger, namely the outside shape, can be made compact.

Figure 4:
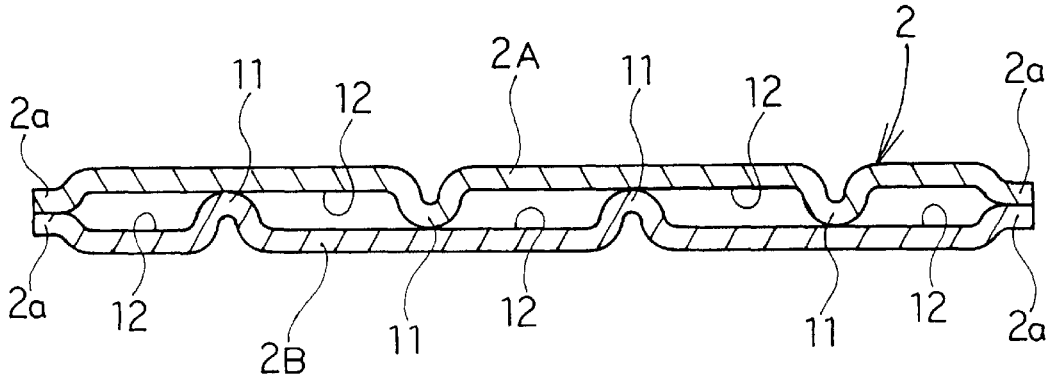
FIG. 4 shows flat tubes for a heat exchanger according to the embodiment, wherein (1) is a cross sectional view to show the main structure taken along line i—i of FIG. 2, and (2) is a cross sectional view to show stoppers taken along line ii—ii of FIG. 2.
Figure 4:
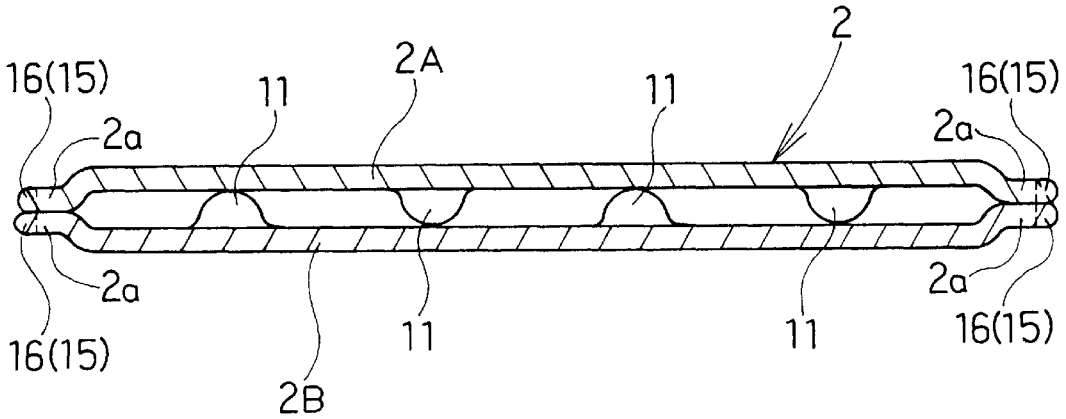

As shown in FIG. 4 (1), these flat tubes 2 are formed of aluminum material to have a transverse cross section in an elliptic shape having parallel portions, a plurality of long beads 11 are integrally formed to protrude towards the tube interior, and a plurality of passages 12, 12 for the medium are formed inside the tubes.

Each flat tube 2 is formed to have a transverse cross section in an elliptic shape having parallel flat portions by bonding two flat tube members 2A, 2B to determine a predetermined height and width optimum for the heat-exchanging rate of the medium flowing the interior.

And, these flat tube members 2A, 2B are formed of an aluminum brazing sheet which is thin and good in heat conductivity, formability and brazing property as the raw material into a semitubular shape to have a flat joined section 2*a* at both ends. And, in the same way as prior art, a bonding area is enlarged by virtue of the junctions 2*a*, 2*a* to provide a sufficient bonding strength of brazing. And, these flat tube members 2A, 2B have the beads 11 having a predetermined height formed in advance along the overall length thereof at least prior to assembling into the single tube 2.

These long beads 11 are alternately protruded from the inner surfaces of the flat tube members 2A, 2B at predetermined positions in the breadth direction of the flat tube 2 towards the tube interior so as to be arranged in four rows in total, and four passages 12, 12 having substantially the same transverse cross-sectional area are formed within the flat tube 2. Specifically, a protruded height of these long beads 11 from the bottom face of the tube is determined to be substantially equal to an inner height of the flat tube 2. And, these long beads 11 are disposed to oppose the flat surface of the flat tube 2. Therefore, the top of each long bead is joined with the inner surface of the flat tube 2 to form the plurality of passages 12, 12 within the flat tube 2 to enhance the heat-exchanging efficiency of the medium passing through these passages 12, 12.

And, as shown in FIG. 4 (2), when the flat tube 2 is completed, the long beads 11 are not formed along the overall length thereof and have an end portion I la continued to the tube's flat face as predetermined in the neighborhood to be bonded with the header pipes 3, 4. And, the outside shape of the tube at each end in the neighborhood to be inserted into the header pipes 3, 4 is flat, and the interior thereof has a single passage which is also flat.

Specifically, both ends of the flat tube 2 are inserted into tube insertion holes 9 formed on the header pipe 4 as shown in FIG. 2 and FIG. 3. The header pipe 3 has the same structure though it is not illustrated and description thereof will be omitted for simplification.

And, a burring 9*a*, which is protruded in the longitudinal direction of the flat tube 2 to be fitted into the header pipes, is integrally formed with the tube insertion holes 9 of these header pipes 3, 4 to facilitate the insertion of the flat tubes 2 and to secure a large contact area with the tubes 2, enabling to make brazing with reliability.

Since both ends of the flat tubes 2 are brazed after being inserted into the tube insertion holes 9 of the header pipes 3, 4 which are formed corresponding to the outer shapes of transverse cross section of the flat tubes 2, they are formed to have the flat surface without forming the bead 11, making it airtight at the junctions.

Specifically, the tube insertion portion having the flat outer shape is formed by pressing the long bead 11 which was previously formed over the overall length in the longitudinal direction of the tube 2 so as to have the flat shape by plastic deformation by means of rolls or a press. Therefore, even if a large number of beads 11 are formed on the flat tubes 2, bonding of the header pipes 3, 4 and the flat tubes 2 is effected by the flat portions of the flat tubes 2, so that brazing can be performed surely and satisfactorily, and sufficient airtightness and pressure resistance can be secured.

A dimension of the flat portion of the flat tube in the longitudinal direction of the tube is preferably about 5 mm to absorb an assembling error and also to make effective a dispersion effect by the burring 9*a* when the burring 9*a* is formed in the insertion holes 9 of the header pipes 3, 4.

Besides, a wall relief 15, which is formed in the breadth direction of the tube when the flat portions at both ends of the tube are formed, is used to form a stopper 16 for limiting the insertion level of the tube into the header pipe, so that the tube insertion level is fixed constant, and the pressure resistance of the flat tube 2 is improved. The stopper 16 makes the tube insertion level constant to improve the pressure resistance of the flat tube 2 itself.

Figure 5:
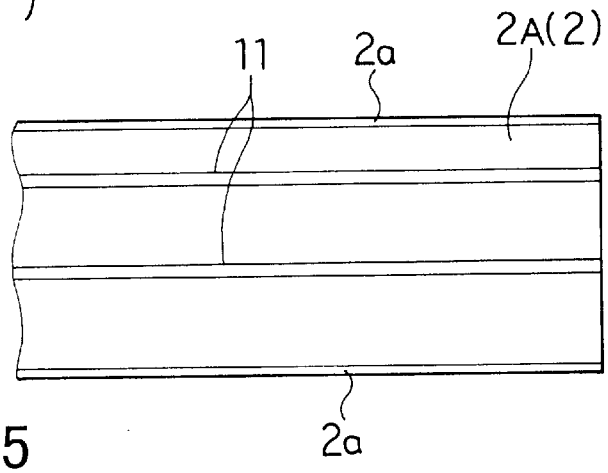
FIG. 5 shows illustrations of a process to form stoppers according to the embodiment, wherein (1) is a plan view showing a tube in an initial state, (2) is a plan view showing a tube with a wall relief formed, and (3) is a plan view showing a tube with stoppers formed.
Figure 5:
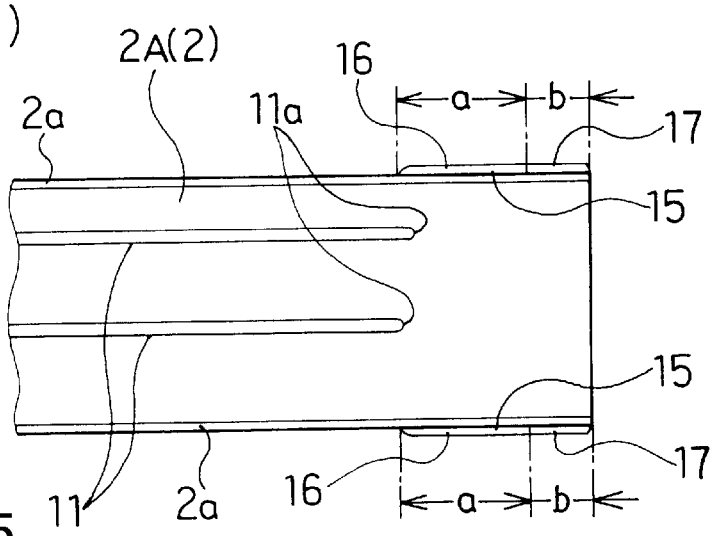
Figure 5:
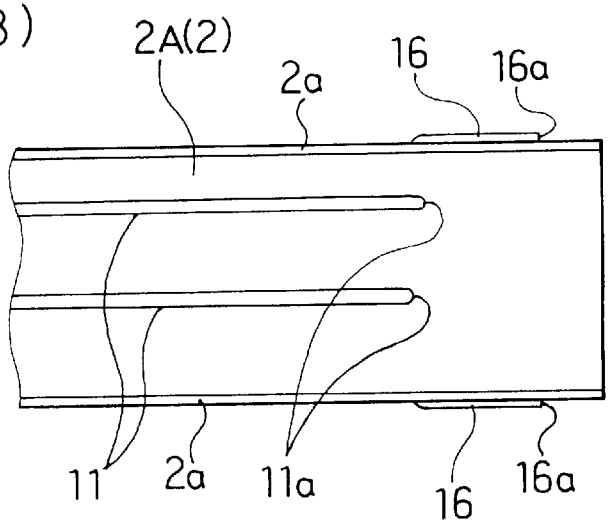

Specifically, to form the flat sections at the ends of the tube for insertion into the header pipe as described above, the beads 11 previously formed in the neighborhood of the tube insertion are pressed back by rolls or a press as shown in FIG. 5 (1). And, when pressing back, the wall relief 15 protruded in the breadth direction of the tube is formed to correspond to the overall length of the pressed-back beads as shown in FIG. 5 (2). For example, when the tube wall thickness is 0.4 mm and the flat tube has a height of 0.5 mm and a width of 18 mm as the tube, the wall relief 15 protruded by about 0.4 mm in the breadth direction of the tube is formed to serve satisfactorily as the stopper 16.

And, as shown in FIG. 5 (3), the wall relief 15 is cut off by a predetermined length in the longitudinal direction of the tube to use the remained portion as the stopper 16, so that the insertion level of the flat tube 2 into the header pipe 4 (3) can be restricted. Specifically, a length b of the cut section 17 from the tube end is determined to a predetermined length based on the transverse cross sectional shape of the header pipe and the tube insertion level.

Thus, the stopper 16 in an elongate shape having a predetermined length a can be formed in the longitudinal direction of the tube. And, to insert the end of the flat tube 2 into the tube insertion hole 9 of the header pipe 4 (3), an end 16*a* of the stopper 16 on the side of the header pipe comes in contact with the outer peripheral wall of the header pipe 4 (3). and a length of the tube end protruded into the header pipe, namely the tube insertion level, can be made constant by being secured and stabilized.

And, since the wall relief 15 was conventionally not needed and removed by a dedicated removing step, so that the removing step can be changed into a cutting step with ease.

Therefore, the insertion level of the flat tube can be kept constant and the flat sections of the respective tubes 2 have the same flat level, so that stresses to be applied to the flat sections of the tube due to the internal pressure of the flowing medium are made uniform, and the pressure strength of the flat tube 2 can be improved.

This embodiment is related to the formation of the four beads in the flat tube to form the four medium passages within the tube, but it is not limited thereto and can also be applied to the formation of a desired number of beads. And, the beads in this embodiment are alternately formed on the upper and lower surfaces of the tube but can also be formed on one surface only or on both inner surfaces so as to be mutually contacted in the tube.

And, in the same way, this embodiment is applied to dispose these beads at equal intervals in the breadth direction of the tube, but can be applied to dispose at desired intervals.

Besides, the above-described embodiment was applied to the continuous formation of the long beads in the longitudinal direction of the tube, but it is not limited thereto and can be applied to intermittent or spot disposition of various types of beads or to disposition of gaps at predetermined points on the long beads so as to communicate the neighboring passages.

In addition, if the protruded level of the wall relief in the breadth direction of the tube degrades other operability or exceeds a design size of the heat exchanger, a disused section in the breadth direction may be removed as required.

As described above, in the flat tube for the heat exchanger according to this embodiment, the wall relief which protrudes in the breadth direction of the tube which has the beads previously formed over the overall length in the longitudinal direction is cut as predetermined when the flat section is formed at the tube ends for the tube insertion and the remained section is used as the stopper, so that the accuracy of the insertion level of the flat tube into the header pipe can be kept stably, and performance and pressure resistance can be enhanced, thus the flat tube for the heat exchanger having improved reliability and quality can be obtained.

Specifically, to form the flat section for the tube insertion, since the wall relief to be formed was conventionally removed as the disused section, it can be used effectively and this conventional removing step can be changed to the cutting step to form the stopper. Thus, it is advantageous in view of the number of steps. And, the cutting step itself can be achieved easily by simply removing the wall relief for a predetermined distance from the tube end without requiring high processing accuracy.

And, since the wall relief which is to be the stopper is formed into a predetermined length along the longitudinal direction of the tube, it can also be applied when rigidity strength is enhanced in the longitudinal direction of the tube, and a force to be applied to the stopper in the longitudinal direction of the tube, namely a pushing force to insert the tube, is high. And, the tube can be firmly fitted to the header pipe.

In addition, the formation of the wall relief which forms the stopper is incorporated into the series of tube production processes and can be applied to any tubes having the beads formed in advance regardless of the size of the tubes. Thus, it can be used extensively.

The wall relief is formed on the outside of the tube without blocking the passage shape inside the tube and used as the stopper, so that the medium within the tube can be kept to flow smoothly. Besides, since the stopper member is disposed in the tube not to restrain the tube insertion level by contacting to the tube end, the shape of the header pipe is limited, and the inflow or outflow of the refrigerant into the tubes or the flow of the medium within the header pipes can be kept smooth.

The flat tube for the heat exchanger according to the invention will be described based on a second embodiment shown in FIG. 6 and FIG. 7. The flat tube 2 for the heat exchanger of this embodiment is different from the previously described embodiment and formed of a single plate. A cross sectional view of the flat tube of this embodiment is omitted, but in the same way as in the previous embodiment, four long beads are disposed to form four passages within the tube.

Figure 6:
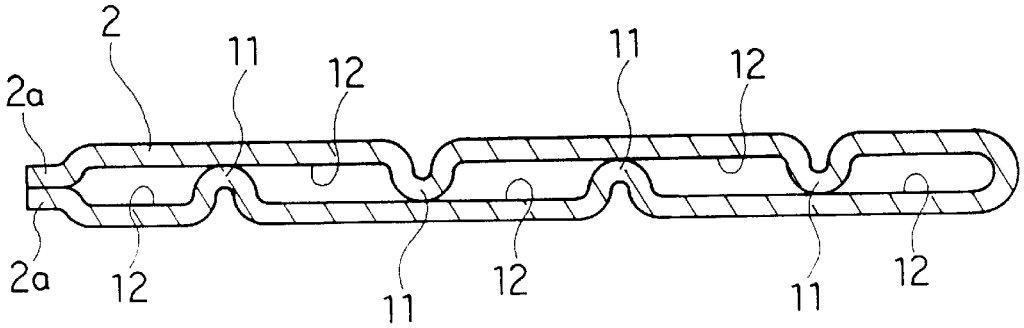
FIG. 6 shows flat tubes for a heat exchanger according to the embodiment, wherein (1) is a cross sectional view to show the main structure of a tube at its middle section, and (2) is a cross sectional view to show a stopper in the neighborhood of the tube end.
Figure 6:
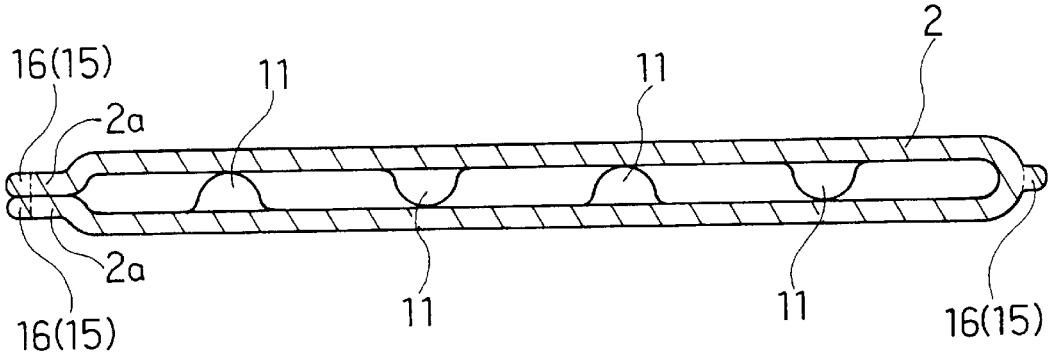

Specifically, as shown in FIG. 6 (1), the flat tube 2 for the heat exchanger used in this embodiment is formed by processing a single brazing sheet. Therefore, this flat tube 2 does not need a labor of assembling the tube into one body as compared with the tube having a two-split structure, facilitating the production, and it is advantageous in view of a pressure resistance because it is formed of a single member.

Figure 7:
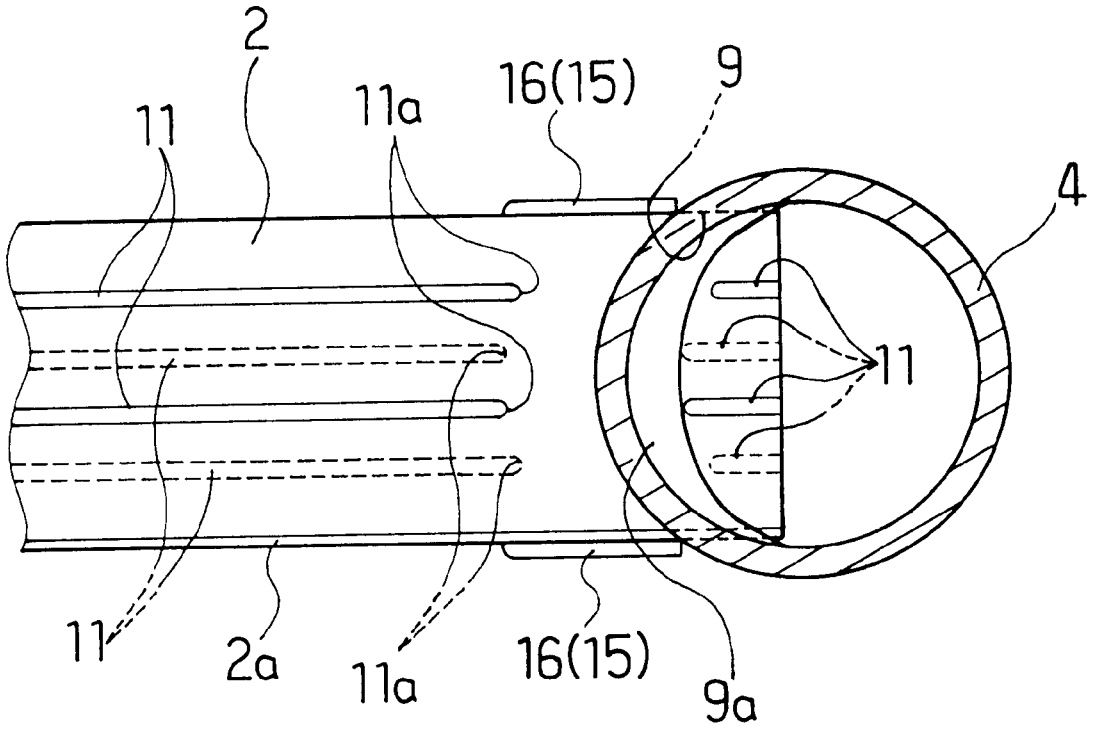
FIG. 7 is a partly enlarged plan view showing a joined section of flat tubes and a header pipe with parts partially broken away according to a second embodiment of the invention.

As shown in FIG. 7 the tube 2 of this embodiment is different from the previously described embodiment, the beads 11 are remained at the tube end positioned in the header pipe 4 (3) to enhance the pressure resistance at the tube end, and the wall relief 15 described above is formed in the neighborhood of the joined section of the tube 11 and the header pipe 4 (3).

Specifically, the tube 2 of this embodiment has a predetermined number of beads 11 formed previously over the overall length of the tube. Among these beads 11, the beads 11 only in the neighborhood of the joined section of the tube 2 and the header pipe 4 (3) are pressed back, and as shown in FIG. 6 (2), the wall relief 15 is formed on the pushed-back bead section only in the breadth direction of the tube.

The wall relief 15 is formed at both ends of the flat tube in the breadth direction when the tube formed of a flat material is bent in the breadth direction into a flat tube shape. Specifically, when one plate is bent into a tube, a jig such as a press receiver is inserted at the end of the flat tube, beads forming the upper flat section of the tube and beads forming the lower flat section are pressed back together so as to be flat by pressing equipment such as a separate press or rollers provided with press projections to be driven in synchronization. Thus, the wall relief 15 is formed to protrude out of the tube not only at both ends of the flat material-shape tube in the breadth direction but also at the positions held by such equipment and pressed back in the breadth direction. Therefore, when the tube is formed into the flat tube shape, the wall relief 15 formed is positioned at both ends of the flat tube in the breadth direction.

And, the wall relief 15 formed on both sides of the flat tube in its breadth direction becomes the stopper 16 to restrict the tube insertion level by the section remained after removing a predetermined section from the tube end. Therefore, a portion removed from the wall relief 15 is small, the material can be used effectively, removing equipment is not abraded heavily, and the workability can be improved.

This embodiment is referred to the header pipe opposed to at least the flat tube which has a transverse cross section in a circular shape of an axial symmetry with respect to the longitudinal center line of the flat tube but not limited thereto, and it can also be applied to one having a transverse cross section in an odd shape, and further applied to one having a different mounting angle of the flat tube as desired with respect to the one with the odd shape.

And, as to a heat exchanger having right and left header pipes with a different outer shape and a heat exchanger having a plurality of different header pipes combined, the bead end position can be determined in the same way according to the respective outer shapes.

As described above, the flat tube for the heat exchanger of this embodiment can give a sufficient pressure resistance to the tube in the same way as in the previously described embodiment and also improve the productivity and pressure resistance of the tube itself.

Specifically, since the tube is formed of a single material and the beads are remained at the tube ends positioned within the header pipes, pressure resistance of the tube itself can be enhanced further. dispersion effect by the bar ring when the bar ring 9*a* is formed in the insertion hole 9 of the header tanks 3, 4.

Figure 8:
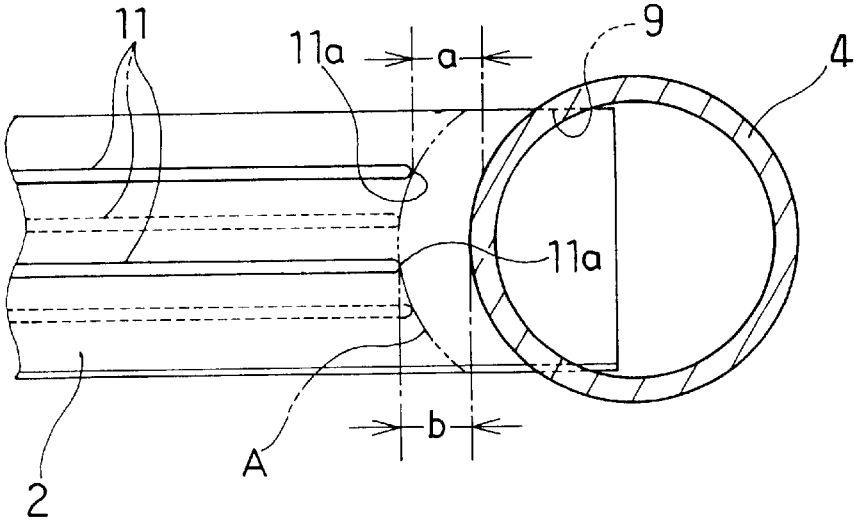
FIG. 8 is a partly enlarged plan view showing a joined section of flat tubes and a header tank with parts partially broken away according to the same embodiment.

In FIG. 8, according to the outside shape of the header tank on the side of the flat tube, the flat section of the flat tube, namely the end section 11*a* of each long bead 11 forming the flat section, is determined to be at a predetermined position to improve the pressure resistance of the flat tube.

The positions of the long bead end sections 11*a* of these flat tubes determined so that a distance from the tube end section 11*a* to the outside shape of the header tanks 3, 4 to be joined becomes constant at all times in the longitudinal direction of the tube depending on the outside shape of the header tanks 3, 4 while assembling and at the termination of production.

Specifically, the respective long bead end sections 11*a* are formed to align on an imaginary line A indicating the outline of the header tanks 3, 4, which are opposed to the respective long bead end sections 11*a* when assembled to the header tanks 3, 4 in advance, moved in parallel by the above-described predetermined distance in the longitudinal direction of the tube. Therefore, as shown in the drawing, the distances a, b from the end sections 11*a* of the long beads 11 to the outer periphery of the header tanks 3, 4 are constant.

Thus, in all long beads 11 disposed in the flat tubes, since a distance from the ends of the respective long beads 11 to the outer periphery of the header tanks in the longitudinal direction of the flat tubes is always kept constant, stresses to be applied to the flat sections of the tubes due to the internal pressure can be prevented from becoming uneven, and a compressive strength of the flat tubes 2 can be improved.

This embodiment is described by referring to the flat tubes formed by bending a single plate, but it can also be applied to those formed by overlaying two plates, or by combining a larger number of split plates.

And, the embodiment is also applied to forming of four beads in the flat tubes to form four passages for the medium in the tubes, but it is not limited thereto and can be applied to forming of a desired number of beads. And, the beads of this embodiment are alternately disposed on the upper and lower surfaces of the tubes but may also be disposed on one surface only.

Besides, this embodiment is applied to disposing of these beads at equal intervals in the breadth direction of the tubes, but can also be applied to disposing of them at predetermined intervals.

Furthermore, the above embodiment is applied to forming of the long beads continuously in the longitudinal direction of the tubes, but it is not limited thereto and can also be applied to arranging various beads intermittently, or forming of gaps at predetermined positions of the long beads to communicate the neighboring passages.

As described above, the flat tubes for a heat exchanger of this embodiment have the positions of the bead end sections of the flat tubes determined according to the outside shape of the header tank, so that the flat tubes for the heat exchanger obtained can have enhanced pressure resistance and improved reliability. Specifically, by disposing the end section on each long bead and determining the distance from the end section to the outer periphery of the header tank to be constant, the stresses at the pertinent points of the tube not provided with the beads are prevented from becoming uneven due to the internal pressure of the medium flowing the interior, and pressure resistance can be improved.

Now, the flat tubes for a heat exchanger of the invention will be described based on a second embodiment shown in FIG. 9 The flat tubes for the heat exchanger of this embodiment have the long bead ends of the flat tubes determined corresponding to the header tanks having the outside shape different from the previous embodiment. The flat tubes of this embodiment have four long beads to form four passages within the tubes in the same way as in the previous embodiment.

Figure 9:
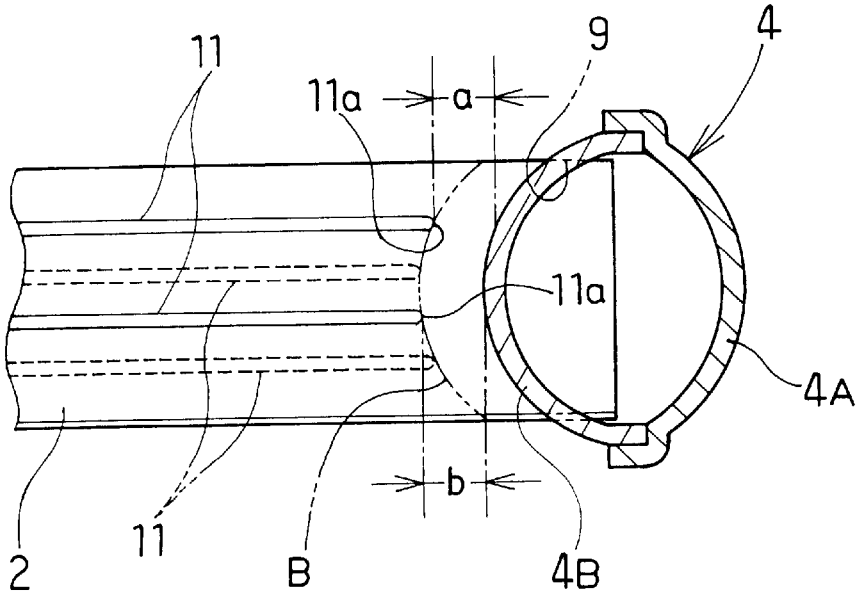
FIG. 9 is a partly enlarged plan view showing a joined section of flat tubes and a header tank with parts partially broken away according to a second embodiment of the invention.

As shown in FIG. 9, the header tank 4 used in this embodiment has a two-split structure formed by combining two header tank members 4A, 4B having a different round radius, and the outer periphery of the header tank 4 opposed to at least the flat tube 2 has a round radius larger than in the previous embodiment. Therefore, since the header tank has the two-split structure, a large header tank having a large capacity which is hardly produced integrally or a header tank having an odd shape suitable to a disposing space can be produced with ease.

And, the respective long bead ends 11*a* are formed to align on an imaginary line B indicating the outline of the header tanks 3, 4, which are opposed to the respective long bead end sections 11*a* when assembled to the header tanks 3, 4 in advance, moved in parallel by the above-described predetermined distance in the longitudinal direction of the tube. Therefore, as shown in the drawing, the distances a, b from the end sections 11*a* of the long beads 11 to the outer periphery of the header tanks 3, 4 are constant.

Therefore, in the same way as in the previous embodiment, in all long beads 11 disposed in the flat tubes, since a distance from the ends of the respective long beads 11 to the outer periphery of the header tanks in the longitudinal direction of the flat tubes is always kept constant, stresses to be applied to the flat sections of the tubes due to the internal pressure can be prevented from becoming uneven, and a compressive strength of the flat tubes 2 can be improved.

This embodiment is referred to the header tank opposed to at least the flat tube and having a transverse cross section in a circular shape of an axial symmetry with respect to the longitudinal center line of the flat tube but not limited thereto, and it can also be applied to one having a transverse cross section in an odd shape, and further applied to one having a different mounting angle of the flat tube as desired with respect to the one with the odd shape.

And, as to a heat exchanger having right and left header tanks with a different outside shape and a heat exchanger having a plurality of different header tanks combined, the bead end position can be determined in the same way according to the respective outside shapes.

As described above, the flat tube for the heat exchanger of this embodiment can improve the pressure resistance of the tube in the same way as in the previously described embodiment and can also cope with header tanks having various transverse cross sectional shapes, enabling to expand its applicable range.

Figure 10:
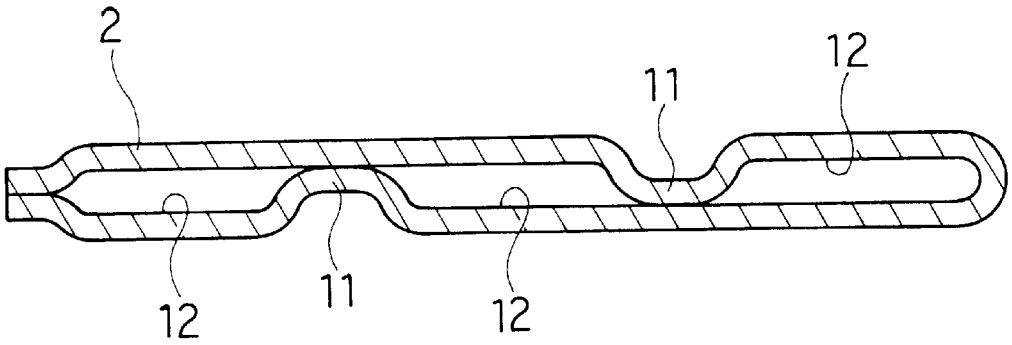
FIG. 10 is a cross sectional view showing the main structure of a flat tube according to a third embodiment of the invention.
Figure 11:
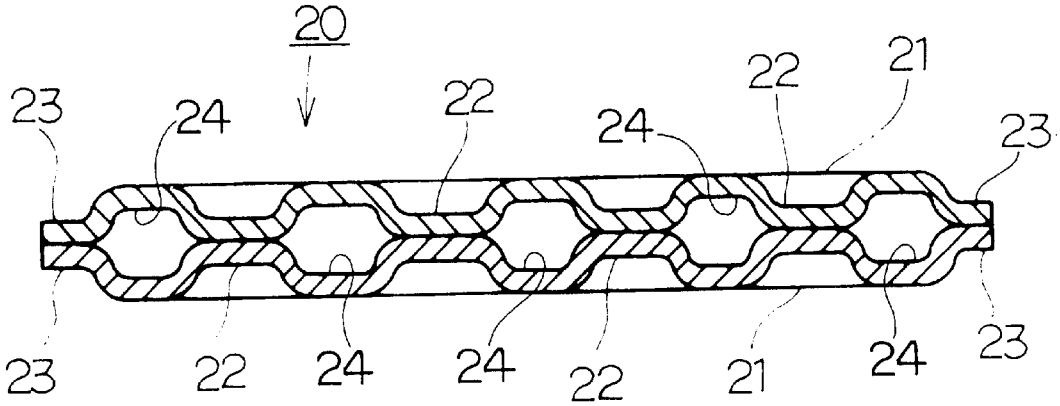
FIG. 11 Prior Art
FIG. 11 is a cross sectional view showing the main structure of a flat tube for a heat exchanger according to prior art.
Figure 12:
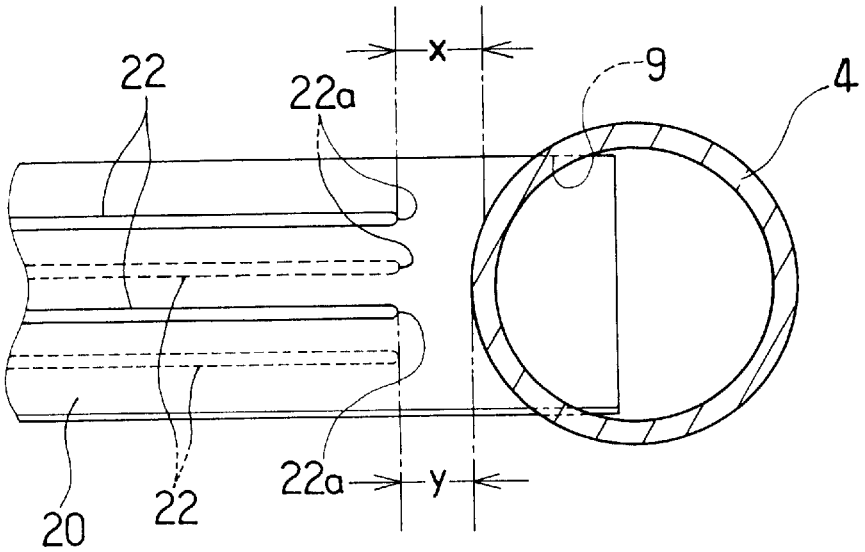
FIG. 12 Prior Art
FIG. 12 is a partly enlarged plan view showing a joined section of a flat tube and a header tank with parts partially broken away according to prior art.
Figure 13:
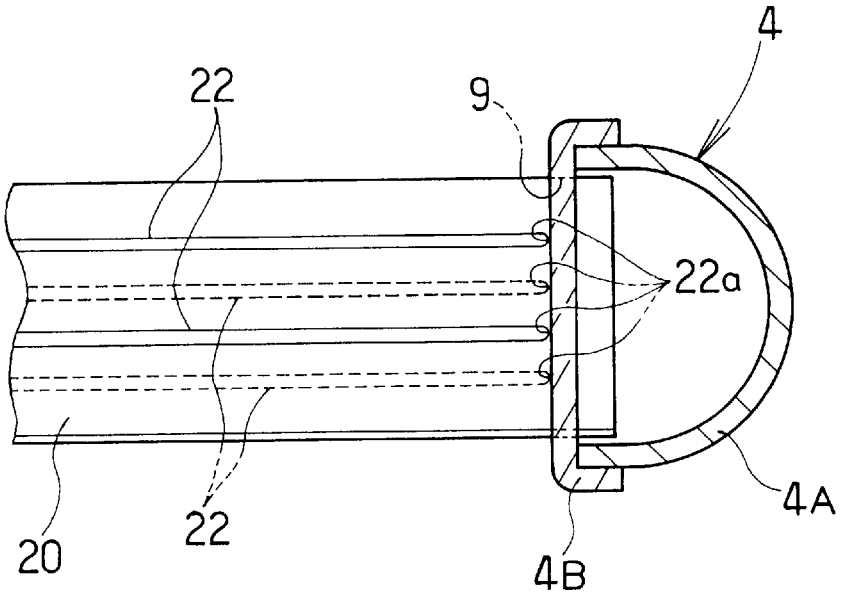
FIG. 13 Prior Art
FIG. 13 is a partly enlarged plan view showing a joined section of a flat tube and a header tank with parts partially broken away according to another prior art.

Besides, the flat tube for the heat exchanger of the invention will be described based on a third embodiment shown in FIG. 10. The flat tube of this embodiment has two beads disposed on the flat tube. Specifically, as shown in FIG. 10 the flat tube 2 of this embodiment has two beads 11 formed to form three passages 12, 12 within the tube. In this case, a distance from the ends of the beads 11 to the outer periphery of the header tank is determined to be constant, so that stresses to be applied to the flat sections of the tubes due to the internal pressure can be prevented from becoming uneven, and a compressive strength of the flat tubes 2 can be improved.

What is claimed is:

1. A flat tube for a heat exchanger formed by bending a single plate or overlaying two plates characterized in that long beads in a plurality of rows are formed on the single plate or two plates in the longitudinal direction of the single plate or two plates, portions of the plate or two plates to which said long beads are opposed are formed flat, and the tops of the respective long beads and said flat portions of the plate or two plates are joined together, thereby forming a plurality of passages by said long beads and said flat portions, and said flat tube is provided with tube insertion sections to be inserted into tube insertion holes of a header tank, said tube insertion section are formed by pressing back sections at ends of said long beads to a flat form such that the respective long beads are terminated at an equal distance from the outer periphery of the header tank having a circular or an elliptical shape.

2. A flat tube for a heat exchanger according to claim 1, wherein said long beads provided on the single plate or two plates are formed by a roll forming machine, and said tube insertion section are plastically deformed to be returned to flat by a pressing machine.

3. A flat tube for a heat exchanger according to claim 1, wherein said tube insertion sections in the flat form have a dimension in the longitudinal direction in the order of 5 mm.

* * * * *